US006561890B2

(12) United States Patent
Tominaga

(10) Patent No.: US 6,561,890 B2
(45) Date of Patent: May 13, 2003

(54) POLISHING PAD

(75) Inventor: Shigeru Tominaga, Tokyo (JP)

(73) Assignees: Ace Inc., Kanagawa-ken (JP); Roki Techno Co., Ltd., Tokyo (JP)

( * ) Notice: Subject to any disclaimer, the term of this patent is extended or adjusted under 35 U.S.C. 154(b) by 0 days.

(21) Appl. No.: 09/895,300

(22) Filed: Jul. 2, 2001

(65) Prior Publication Data

US 2002/0065032 A1 May 30, 2002

(51) Int. Cl.[7] ..... B24D 11/00
(52) U.S. Cl. ..... 451/526; 451/527; 51/309
(58) Field of Search ..... 451/526, 527, 451/533, 41, 539, 28, 528

(56) References Cited

U.S. PATENT DOCUMENTS 4,466,218 A * 8/1984 Ottman et al. ..... 451/527
5,016,401 A * 5/1991 Mangus ..... 15/218.1
5,335,457 A * 8/1994 Matsuda et al. ..... 51/284 R
5,893,755 A * 4/1999 Nakayoshi ..... 451/41
6,056,627 A * 5/2000 Mizuta ..... 451/533
6,077,153 A * 6/2000 Fujita et al. ..... 451/287
6,120,352 A * 9/2000 Duescher ..... 451/41
6,306,021 B1 * 10/2001 Masumura et al. ..... 451/526
6,306,957 B1 * 10/2001 Nakano et al. ..... 524/700
6,309,563 B1 * 10/2001 Iino et al. ..... 252/514
6,313,210 B1 * 11/2001 Lin et al. ..... 524/492
6,319,108 B1 * 11/2001 Adefris et al. ..... 451/526
6,328,644 B1 * 12/2001 Kuramochi et al. ..... 451/526

FOREIGN PATENT DOCUMENTS

JP 02001179609 A * 7/2001 ..... B24B/37/00

* cited by examiner

*Primary Examiner*—Eileen P. Morgan
*Assistant Examiner*—Hadi Shakeri
(74) *Attorney, Agent, or Firm*—Wenderoth, Lind & Ponack, L.L.P.

(57) ABSTRACT

A polishing pad for use in chemical mechanical polishing is formed of silicone rubber. An abrasive fine inorganic powder and a reinforcing fine silica powder are dispersed in the silicone rubber, and the inorganic powder has a particle size of 0.01–100 $\mu$m and is contained in the amount of 10–85 wt.% of the silicone rubber.

7 Claims, 2 Drawing Sheets

POLISHING PAD

BACKGROUND OF THE INVENTION

This invention relates to a polishing pad for use in precision polishing of semiconductor wafers, liquid-crystal glass, hard disks, etc. More particularly, the invention relates to polishing pads for use in chemical mechanical polishing.

As today's integrated semiconductor circuits have higher packing density and smaller feature size, their fabrication process has become increasingly complicated and the surfaces of semiconductor devices are not always planar. Steps on device surfaces will make conductor paths discontinuous at the steps and increase resistance in limited areas, which in turn cause current discontinuity and reduced interconnect capacitance. In addition, insulation films will have lower ability to withstand voltage, and current leakage can occur.

This is probably the reason why planarization technology has become essential in the process of semiconductor fabrication. One of the promising methods for planarizing semiconductor surfaces is a chemical mechanical polishing technique. Chemical mechanical polishing (hereunder abbreviated as CMP) has evolved from the technology of mirror polishing silicon wafers, and an apparatus for implementing this method is shown in FIG. 1.

A conventional polishing apparatus generally indicated by 1 in FIG. 1 comprises a platen 2 that is driven to rotate and a polishing pad 3 placed on it. A wafer 4 retained by a polishing head 7 is placed in contact with the polishing pad 3. With this setup, the platen 2 is driven to rotate with a downward load on the polishing head 7 so that it oscillates in the radial direction of the platen 2.

Parallel with this movement, a polishing slurry 6 is delivered from a supply nozzle 5 onto the polishing pad 3 so that the slurry 6 is supplied to the underside of the wafer 4 to planarize its outermost surface. To be more specific, the slurry 6 spreads over the polishing pad 3 and as the latter moves relative to the wafer 4, the slurry 6 gets into the gap between the sliding surfaces, thereby polishing the surface of the wafer 4. The mechanical polishing by the relative motions of the pad 3 and the wafer 4 combines synergistically with the chemical action of the slurry 6 to achieve effective polishing.

The polishing pad 3 has in most cases been a sheet of polyurethane foam. However, polishing wafers on a pad in sheet form made of polyurethane foam has involved the following problems.

(A) Since the pad has a dual structure consisting of a sponge layer and an abrasive layer, moisture intrudes from the boundary and the pad swells on the perimeter, leading to increased deterioration in polishing uniformity on the circular edge of the wafer. This results in lower device yield, particularly in the recent years when more than one kind of device is formed on a single wafer.

(B) On account of the foamed structure in the pad surface, compressive deformation tends to occur in surface cells under load and the state of polishing differs from wafer to wafer.

(c) The polishing slurry and debris get into cells in the foamed surface and adhere, often clogging the pad surface. Hence, the polishing performance of the pad decreases and scratches will occur to lower the device yield.

To cope with the problems (B) and (C), the surface of the pad used several times has to be scraped by a suitable device such as a diamond grinder. This dressing step has been an obstacle to the effort of improving process efficiency.

SUMMARY OF THE INVENTION

An object, therefore, of the present invention is to provide a polishing pad that has sufficient wet strength to prevent nonuniformity in polishing on the circular edge and which also has resistance to chemicals such as alkalis and acids.

Another object of the invention is to provide a polishing pad that can offer sufficient surface strength to achieve the intended polishing by selecting a suitable kind of abrasive fine inorganic powder and adjusting its loading and which still has little need for dressing.

A further object of the invention is to provide a polishing pad that is functional with a chemical fluid or water in the absence of any polishing slurry or using a polishing slurry loaded with a very small amount of polishing agent.

These objects of the invention can be attained by dispersing an abrasive fine inorganic powder in silicone rubber.

According to the invention, the abrasive fine inorganic powder loaded in a pad substrate not only confers polishing performance but also renders the pad substrate to have a suitable degree of wearability. Hence, as more wafers are polished, the surface of the pad is scraped little by little to expose a new polishing surface.

In essence, the polishing pad of the invention has an abrasive fine inorganic powder dispersed in silicone rubber and this ensures that no fine abrasive powder need be added or only a very small amount of fine abrasive powder need be added during polishing. In addition, the pad surface is scraped little by little as polishing progresses, so there is no need for the dressing operation. In other words, because the fine inorganic powder is dispersed throughout the silicone rubber of the polishing pad, a new surface with inorganic particles is continuously formed as the polishine progresses.

It should be emphasized that there has not been known any idea of polishing pads that need little or no addition of an abrasive fine powder during polishing or those which are scraped little by little on the surface as the polishing process progresses. In addition, no commercial products of such polishing pads have been available to date.

DETAILED DESCRIPTION OF THE INVENTION

An embodiment of the invention is described below with reference to the accompanying drawings.

The silicone rubber 2 to be used in the invention is not limited to any particular kind as long as it is of a millable type that can be blended with a vulcanizing agent by a suitable means such as a twin roll or a Banbury mixer and later vulcanized with heat to form an elastic body. Examples of such silicone rubber in green state include MQ, VMQ, PVMQ and FVMQ (according to the classification in ASTM D 1418), which may be used either independently or in admixture.

Figure 1:
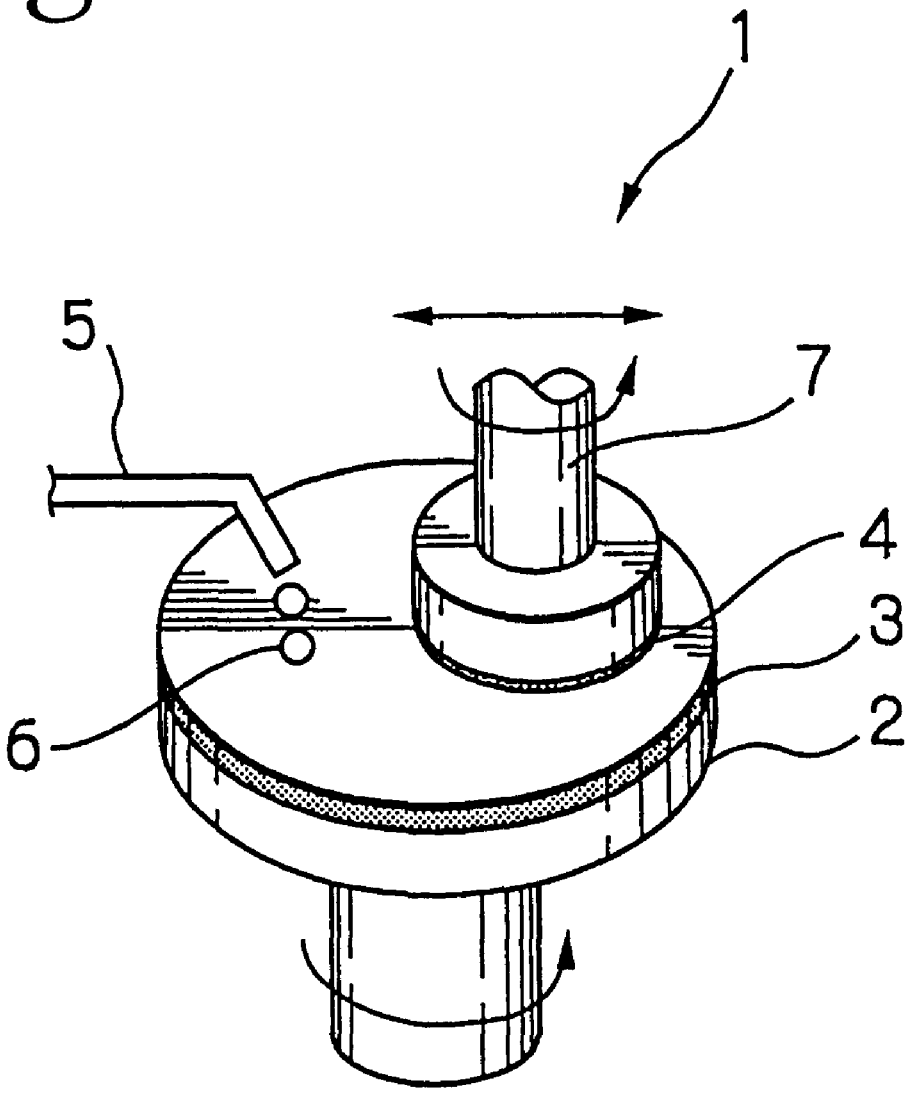
PRIOR ART Fig. 1
FIG. 1 is a simplified perspective view of a conventional CMP apparatus.
Figure 2A:
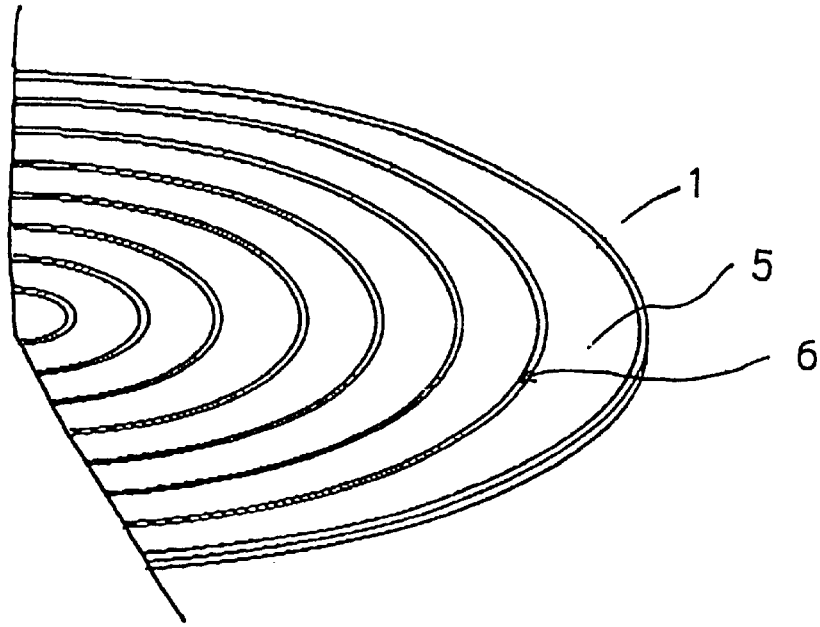
FIG. 2A is a partial perspective view of a polishing pad of the present invention.

The polishing pad 1 shown in FIG. 2A can be shaped by any known forming methods such as press molding, injection molding and extrusion molding, provided that a vulcanizing agent that suits a specific forming method should be selected from known candidates.

Figure 2B:
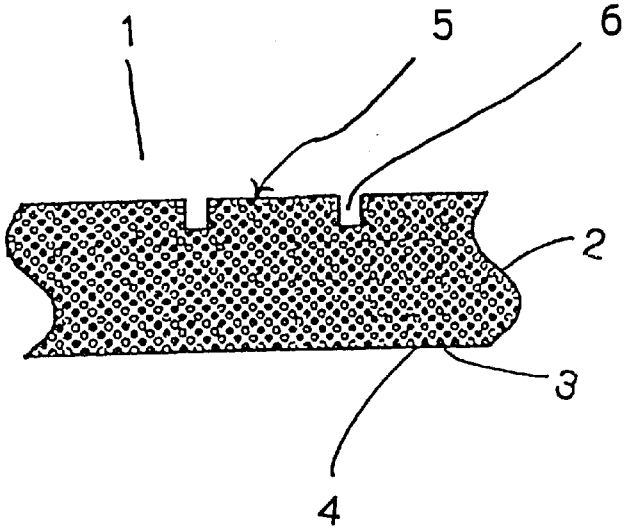
FIG. 2B is a partial sectional view of the polishing pad shown in FIG. 2A.

As shown in FIG. 2B, in order to improve the strength of the silicone rubber, a common reinforcing fine silica powder 3 such as dried silica or precipitated silica is preferably added. Besides the reinforcing fine silica powder, an abrasive fine inorganic powder 4 is also added and dispersed in the silicone rubber 2 with a view to increasing the surface hardness of the polishing pad and modifying its polishing characteristics.

Preferred examples of such abrasive fine inorganic powder 4 include the particles of silicon oxide, cerium oxide and aluminum oxide, which may be used either alone or in admixture. Silicon oxide is particularly preferred since it forms a high-density and uniform dispersion due probably to high compatibility with silicone rubber in a green state.

The particle size of the abrasive fine inorganic powder 4 ranges preferably from 0.01 to 100 $\mu$m. The particles of sizes within this range can not only form a high-density and uniform dispersion, but they also have little likelihood for developing scratches in the wafer surface during polishing.

The addition of the abrasive fine inorganic powder particles is a significant factor to the surface hardness of the shaped polishing pad 1, and they are preferably added in amounts ranging from 10 to 85 wt % of the silicone rubber. If their amount is less than 10 wt % of the silicon rubber, the shaped polishing pad does not have the desired surface hardness. If their amount is more than 85 wt % of the silicone rubber, the pad cannot have adequate tensile strength.

A known dispersion promoter is preferably added as an aid in compounding the abrasive fine inorganic powder in the silicone rubber when the latter is in a green state.

The polishing pad of the invention has preferably a surface hardness of 70–99 degrees (JIS-A), more preferably 70–95 degrees. If it has a lower surface hardness, the polishing pad does not show the required polishing action. If it has a surface hardness in excess of 99 degrees, the pad cannot have adequate tensile strength.

The shaped polishing pad of the invention has smooth surface layers produced as a result of contact with the surfaces of a forming mold or an extruder die. In order to remove these surface layers and give a uniform pad thickness, the surface of the pad is preferably subjected to grinding.

The polishing pad of the invention will generate fine particles as it wears down. In order to retain such fine particles and an optionally added polishing fluid, the pad polishing surface 5 preferably has grooves 6 or punched to make 1–2 mm$^{\Phi}$ holes by a known method.

The following examples are provided for the purpose of further illustrating the present invention, but are in no way to be taken as limiting.

EXAMPLE 1

The ingredients listed in formula (A) were compounded and shaped to a disk 3 mm thick under the conditions specified below in (B). Grooves 6 [see under (B)] were formed in the surface of the disk in the usual manner to fabricate a polishing pad 1 having the physical properties shown below in (C).

(A) Formula

Silicone rubber in a green state: VMQ

Unit siloxane molecule: $[(CH_3)_2SiO][(CH_2{=}CH)(CH_3)_2SiO)]$

Vulcanizing agent: 2,5-dimethyl-2,5-di(t-butylperoxy) hexane, 0.5 wt %

Reinforcing filler: dried silica, 9 wt %

Abrasive fine inorganic powder: fine quartz powder having an average particle size of 1 micron meter, 65 wt %

(B) Shaping

Conditions: press vulcanized at 170° C. for 10 minutes, followed by secondary vulcanization at 200° C. for 4 hours Grooves: 0.01 inch wide by 0.015 inches deep on a pitch of 0.06 inches (C) Physical Properties Hardness: 94 (JIS-A)

Tensile strength: 8.6 MPa·s

Elongation: 60%

(D) Result of Polishing

Using the polishing pad, CMP was performed on a silicon oxide insulation film prepared with a CVD apparatus. The polishing speed was 1300 Å/min (with a polishing slurry supplied). The same experiment was performed injecting pure water in place of the polishing slurry. Polishing was possible at one half the speed of the case in which the polishing slurry was used.

EXAMPLE 2

The procedure of Example 1 was repeated, except that 5 wt % of a fine cerium oxide powder having an average particle size of 1 micron meter was used as the abrasive fine inorganic powder 4. A polishing pad 1 was fabricated which had the physical properties shown below in (C).

(C) Physical Properties

Hardness: 87 (JIS-A)

Tensile strength: 5.2 MPa·s

Elongation: 82%

(D) Result of Polishing

Using the polishing pad, CMP was performed on a silicon oxide insulation film prepared with a CVD apparatus. The polishing speed was 1600 Å/min (with a polishing slurry supplied). The same experiment was performed injecting pure water in place of the polishing slurry. Polishing was possible at one half the speed of the case in which the polishing slurry was used.

COMPARATIVE EXAMPLE 1

A polishing pad was fabricated by repeating the procedure of Example 1, except that no abrasive fine inorganic powder was used. The physical properties of the polishing pad and the result of polishing with it are shown below.

(C) Physical Properties

Hardness: 76 (JIS-A)

Tensile strength: 8.6 MPa·s

Elongation: 300%

(D) Result of Polishing

Using the polishing pad, CMP was performed on a silicon oxide insulation film prepared with a CVD apparatus. The polishing speed was no faster than 500 Å/min.

The polishing performance data for Examples 1 and 2 and Comparative Example 1 in terms of speed, uniformity, flatness (Å) and scratches are given in Table 1. In each of Examples 1 and 2, two experiments were run, one using the polishing slurry and the other using pure water.

TABLE 1

| Run | Polishing speed (Å/m) | Uniformity | Flatness (Å) | Scratches |
|---|---|---|---|---|
| Ex. 1 (with polishing slurry) | 1300 | no problem | 1800 | no problem |
| Ex. 1 (with pure water) | 600 | no problem | 2000 | no problem |
| Ex. 2 (with polishing slurry) | 1600 | no problem | 1800 | no problem |
| Ex. 2 (with pure water) | 800 | no problem | 2000 | no problem |
| Comp. Ex. 1 | ≦500 | no problem | — | no problem |

As is clear from this data, the polishing pads of the invention allowed for successful polishing without using a polishing slurry.

Being based on silicone rubber, the polishing pad 1 of the invention has not only adequate wet strength but also high chemical resistance. Containing the abrasive fine inorganic powder 4, the polishing pad of the invention has a unique advantage in that it allows for polishing using only a chemical fluid or water, or a polishing slurry containing a very small amount of polishing agent. In addition, as an increasing number of wafers are polished, the surface of the polishing pad of the invention is scraped little by little to expose a new polishing surface, and this eliminates the need for dressing which has been necessary in the prior art.

What is claimed is:

1. A polishing pad comprising:

an elastic body formed of a millable silicone rubber material;

abrasive fine inorganic powder dispersed in said silicone rubber material, said inorganic powder having a particle size in a range of 0.01 μm to 100 μm and being dispersed in said silicone rubber material in an amount in a range of 10 wt % to 85 wt % of said silicone rubber material; and reinforcing fine silica powder dispersed in said silicone rubber material.

2. The polishing pad of claim 1 wherein said silica powder comprises one of dried silica and precipitated silica.

3. The polishing pad of claim 1, wherein said inorganic powder includes at least one of silicon oxide, cerium oxide, and aluminum oxide.

4. The polishing pad of claim 3, wherein said elastic body formed of silicone rubber material having said inorganic powder and said silica powder dispersed therein has a surface hardness of 70 degrees to 99 degrees (JIS-A).

5. The polishing pad of claim 1, wherein said elastic body formed of silicone rubber material having said inorganic powder and said silica powder dispersed therein has a surface hardness of 70 degrees to 99 degrees (JIS-A).

6. The polishing pad of claim 1, further comprising an abrasive polishing surface formed on said elastic body for contacting a surface of a wafer to be polished, said abrasive polishing surface being formed of said silicone rubber having said inorganic powder and said silica powder dispersed therein.

7. The polishing pad of claim 6, wherein said polishing surface has concentric grooves formed therein.

* * * * *